US007811386B2

(12) United States Patent
Han et al.

(10) Patent No.: US 7,811,386 B2
(45) Date of Patent: Oct. 12, 2010

(54) METHOD OF CONTROLLING A DISHWASHING MACHINE HAVING A STEAM GENERATOR

(75) Inventors: Jung Youp Han, Seoul (KR); Yong Jin Choi, Seoul (KR); Joon Ho Pyo, Seoul (KR); Young Hwan Park, Seoul (KR); Seong Ho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 271 days.

(21) Appl. No.: 12/149,401

(22) Filed: Apr. 30, 2008

(65) Prior Publication Data

US 2009/0056755 A1 Mar. 5, 2009

(30) Foreign Application Priority Data

Aug. 31, 2007 (KR) ..... 10-2007-0088339

(51) Int. Cl.

| | |
|---|---|
| ***B08B 3/00*** | (2006.01) |
| ***B08B 3/02*** | (2006.01) |
| ***B08B 3/04*** | (2006.01) |
| ***B08B 3/10*** | (2006.01) |

(52) U.S. Cl. ..... 134/25.2; 134/19; 134/34; 134/30; 134/31

(58) Field of Classification Search ..... 134/18, 134/19, 25.2, 30, 56 D

See application file for complete search history.

(56) References Cited

U.S. PATENT DOCUMENTS

| | | | | |
|---|---|---|---|---|
| 7,594,513 | B2 * | 9/2009 | VanderRoest et al. | 134/56 D |
| 2004/0261824 | A1 * | 12/2004 | Eiermann | 134/57 D |
| 2005/0022849 | A1 * | 2/2005 | Park et al. | 134/58 D |
| 2007/0102026 | A1 * | 5/2007 | Ahn et al. | 134/25.2 |

FOREIGN PATENT DOCUMENTS

| | | | |
|---|---|---|---|
| DE | 4034380 | A1 | 4/1992 |
| EP | 1738677 | A2 | 1/2007 |
| EP | 1790269 | A2 | 5/2007 |
| FR | 2885790 | A1 * | 11/2006 |

* cited by examiner

*Primary Examiner*—Michael Kornakov
*Assistant Examiner*—Natasha Campbell
(74) *Attorney, Agent, or Firm*—McKenna Long & Aldridge LLP

(57) ABSTRACT

A method of controlling a dish washing machine capable of automatically washing items to be washed is disclosed. The method includes performing a steam spraying action defined to spray stream on a plurality of racks containing items to be washed, initiating a first water spraying action defined to spray on at least one first rack which is exposed firstly to the stream, and initiating a second water spraying action defined to spray water on at least one second rack, different from the first rack, wherein spraying water on the first rack begins prior to spraying water on the second rack.

22 Claims, 5 Drawing Sheets

METHOD OF CONTROLLING A DISHWASHING MACHINE HAVING A STEAM GENERATOR

This application claims the benefit of Korean Patent Application No. 10-2007-0088339, filed on Aug. 31, 2007, which is hereby incorporated by reference for all purposes as if fully set forth herein.

BACKGROUND

1. Field of the Disclosure

The disclosure relates to home appliances, and more particularly to a method of controlling a home appliance, and more particularly to a method for controlling a dish washing machine, which enables the dish washing machine to more efficiently wash items to be washed.

2. Discussion of the Related Art

Generally, a dish washing machine is an apparatus that automatically washes items, such as items disposed in a washing compartment, by spraying wash water toward the items at a high pressure to remove foreign matter, such as food particles and residues, which may be attached to surfaces of the items to be washed.

One of the important factors associated with the dish washing machine relates to washability in association with removing foreign matter attached to the surfaces of items to be washed. In order to improve washability, it is necessary to increase a force required to remove foreign matter from the surfaces of items, namely, a spray pressure of the wash water.

However, when the spray pressure of the wash water is excessively high, items in the dish washing machine, such as dishes, may be damaged or even broken. Further, when the items are washed at a high spray pressure, the amount of the wash water required to wash the items increases. Furthermore, even if the wash water is sprayed at the items at a high spray pressure, it may still be difficult to remove foreign matter from the items.

SUMMARY

Accordingly, a dish washing machine that substantially obviates one or more problems due to limitations and disadvantages of the related art is highly desirable.

At least one advantage of the present invention is to provide a method of controlling a dish washing machine capable of enhancing washability.

Another advantage is to provide a method of controlling a dish washing machine capable of reducing the amount of wash water used to wash the items to be washed.

Additional features and advantages will be sent forth in the description that follows, and in part will be apparent from the description, or may be learned by practice of the invention. The aforementioned advantages and features may be realized and attained by the exemplary structures and/or methods particularly pointed out in the written description, claims, and the appended drawings.

The advantages may be achieved by a method for controlling a dish washing machine comprising: performing a steam spraying action defined to spray steam on a plurality of racks containing the items to be washed; initiating a first water spraying action defined to spray water on at least one first rack which is exposed firstly to the steam; and initiating a second water spraying action defined to spray water on at least one second rack different from the first rack, wherein spraying water on the first rack begins prior to spraying water on the second rack.

The advantages may also be achieved by a method of controlling a dish washing machine comprising: performing a steam spraying action configured to spray steam into a tub; initiating a first water spraying action configured to spray water on a steam zone that is set previously among spaces of the tub; and initiating a second water spraying action configured to spray water on other spaces including at least a portion of space in the tub different from the steam zone, wherein the first water spraying action begins prior to the second water spraying action.

The advantage of efficiently washing the items to be washed by spraying water on a rack which is first exposed to steam among a plurality of racks is that, foreign matter attached to the items to be washed, which are first exposed to steam, is sufficiently steeped in steam. Accordingly, the items to be washed can be efficiently washed by removing the steeped foreign matter first.

Furthermore, a water spray time for spraying water on the rack that is first exposed to steam among a plurality of racks is set to be relatively long, thereby more efficiently washing the items to be washed.

It is to be understood that both the forgoing general description and the following detailed description are exemplary and explanatory and should not be construed as limiting the scope of any claim.

BRIEF DESCRIPTION OF THE DRAWINGS

The accompanying drawings, which are included to provide a further understanding of the embodiments described herein, are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Figure 1:
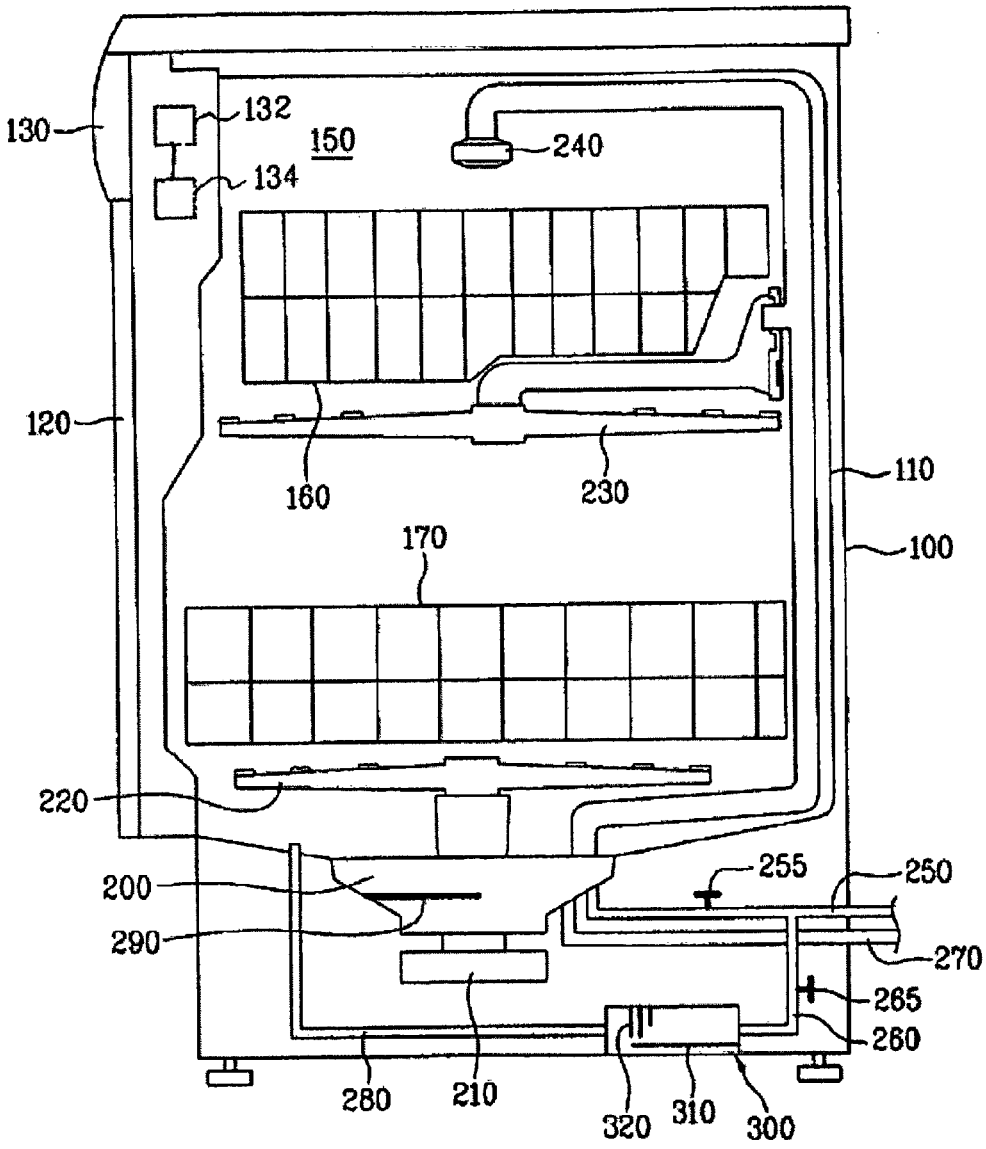
FIG. 1 illustrates a cross-sectional view of a dish washing machine capable of performing a method according to an embodiment of the invention.

Reference will now be made in detail to the preferred embodiments, examples of which are illustrated in the accompanying drawings. Wherever possible, the same reference numbers will be used throughout the drawings to refer to the same or like parts.

A configuration of a dish washing machine according to one embodiment of the invention will be described with reference to FIG. 1.

The dish washing machine may include, for example, a case 100 forming an exterior of the dish washing machine, a door 120 opening and closing the case 100, and a control panel 130 mounted to the case 100 or the door 120 to enable a user to operate the dish washing machine, and a controller 132 and associated memory 134 to control the dish washing machine and store instructions and data, respectively. The controller 132 may be operationally coupled to electricallyoperated parts, such as switches or a keyboard (not shown) on the control panel 130, a pump 210, a steam generator 300, valves 255, 265, and sump heater 290. The controller 132 and associated memory 134 may control the operation of the dish washing machine.

A tub 110 is disposed in the case 100 to define a washing compartment 150 in the case 100 as a space that accommodates items, such as dishes, to be washed. A sump 200 for storing the wash water is arranged below the tub 110.

The sump 200 includes a pump 210 for pumping the wash water stored in the sump 200. The sump may also include a filter (not shown) for filtering contaminated wash water. Further, a sump heater 290 may also be disposed in the sump 200, to heat the wash water stored in the sump 200.

A first water supply tube 250 may be connected to the sump 200 to supply fresh water from an external water supply source to the sump 200. A water drain tube 270 may also be connected to the sump 200 to drain the wash water from the sump 200 to the outside of the dishwasher. A first water supply valve 255 to control the supply of water to the sump 200 may be installed on the water supply tube 250.

At least one rack, such as rack 160, 170 may be arranged in the tub 110, namely, in the washing compartment 150. At least one spray arm 220, 230 may also be arranged in the washing compartment 150 to spray the water pumped by the pump 210 toward the at least one rack 160, 170.

In the exemplary embodiment illustrated in FIG. 1, an upper rack 160 and a lower rack 170 are arranged at upper and lower portions of the washing compartment 150, respectively, and an upper spray arm 230 and a lower spray arm 220 are arranged to spray water, pumped by the pump 210, toward the upper rack 160 and the lower rack 170, respectively.

In addition, a top nozzle 240 may be arranged at an upper portion of the washing compartment 150. The top nozzle 240 functions to spray the water pumped by the pump 210 from the upper portion of the washing compartment 150 to a lower portion thereof.

A dish washing machine according to the present invention may be configured not only to spray the wash water into the washing compartment 150 by the pump 210 and the spray arms 220, 230, and top nozzle 240, but also to spray or supply steam to the washing compartment 150. For this, the dish washing machine according to the present invention includes a steam generator 300 which may be operated independently of the sump heater 290 disposed in the sump 200.

As shown in FIG. 1, the steam generator 300 may communicate with the first water supply tube 250 via the second water supply tube 260. The steam generator 300 also may communicate with the washing compartment 150 of the tub 110 via a steam supply tube 280. A second water supply valve 265 for controlling the supply of water to the steam generator 300 may be installed on the second water supply tube 260.

The steam generator 300 may include a water tank 330, which stores water supplied into the steam generator 300, a steam heater 310 which heats the water stored in the water tank 330, and a water level sensor 320, which senses the water level of the water in the water tank 330 of the steam generator 300. The water level sensor 320 can sense, for example, a low water level and a high water level.

The low water level may be set to protect the steam heater 310 in the steam generator 300 from, for example, becoming exposed to air. The high water level may be set to prevent the water supplied into the steam generator 300 from overflowing the water tank 330 when, for example, the steam generator 300 is operated.

Figure 2:
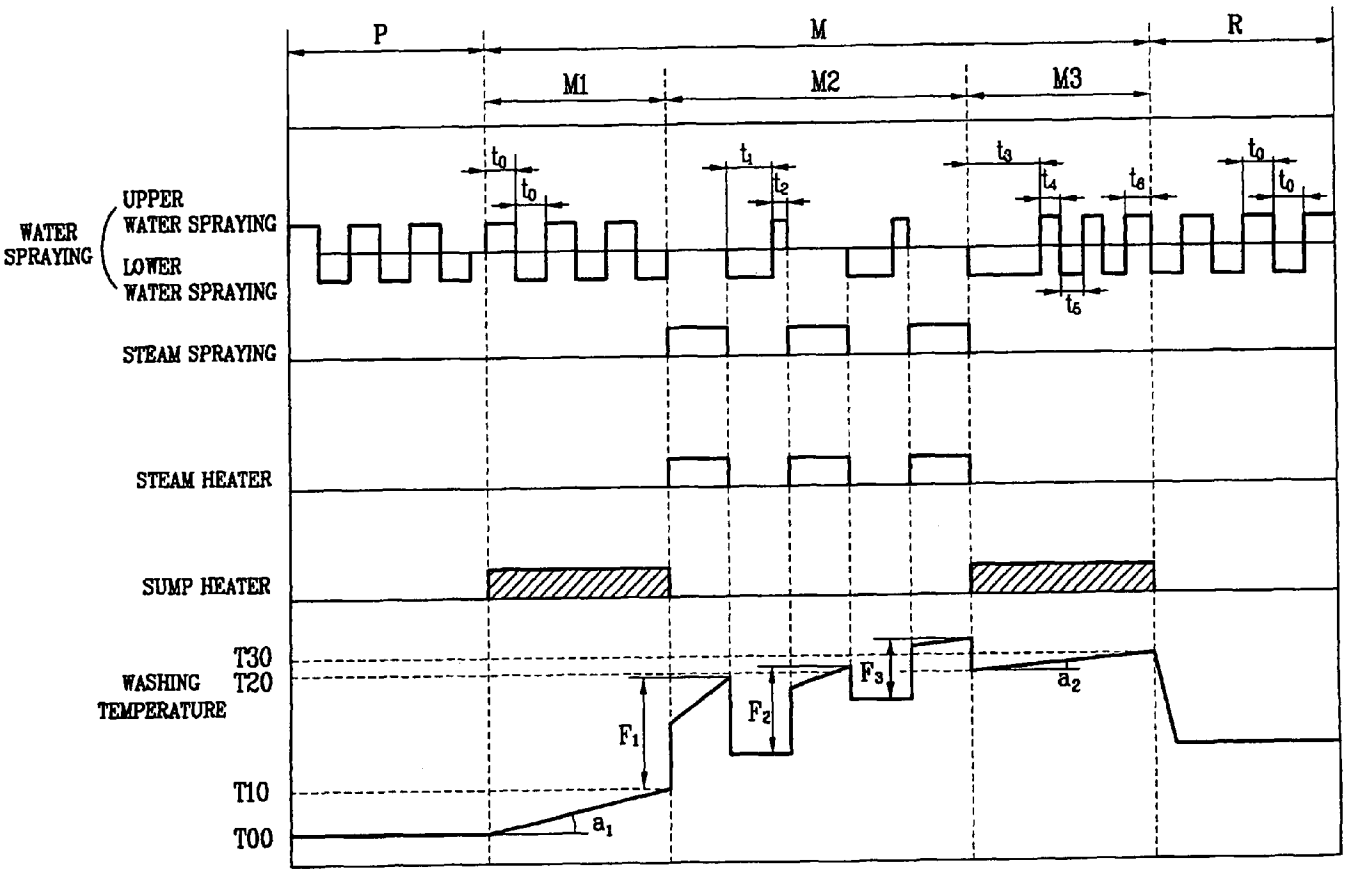
FIG. 2 illustrates a washing process according to an embodiment of the invention, which may be performed in the dish washing machine of FIG. 1.
Figure 3:
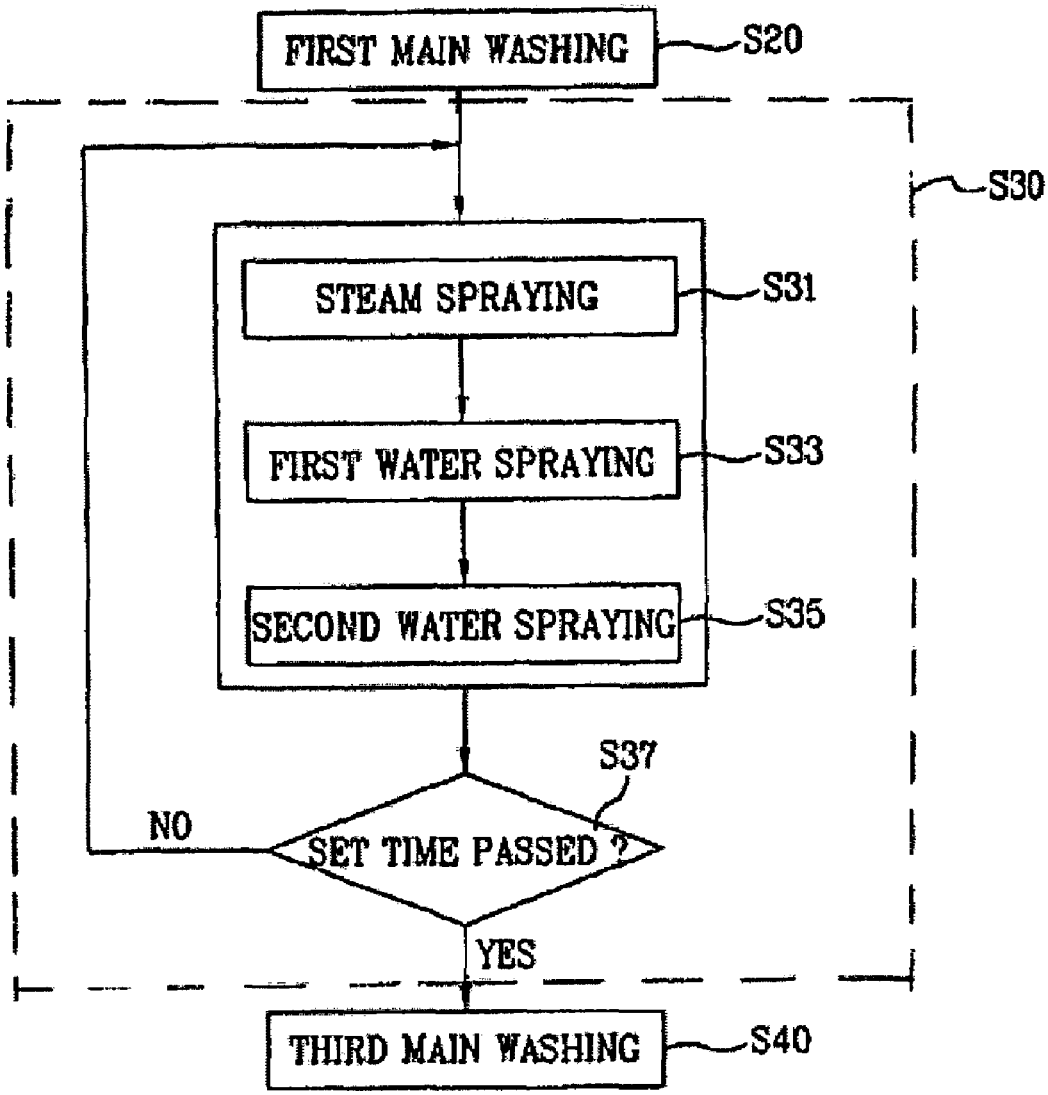
FIG. 3 is a flow chart showing a main washing cycle according to an embodiment of the invention.

Referring to FIGS. 1, 2, and 3, a process of washing items in a washing compartment, according to an embodiment of the invention, is provided.

The process performed in the dish washing machine may include a preliminary washing cycle P, a main washing cycle M, a rinsing cycle R, and a drying cycle D.

The preliminary washing cycle P may include washing the items using wash water without a detergent. The main washing cycle M may include washing the items using wash water with a detergent. The rinsing cycle R may include washing the items by spraying wash water onto the items after the main washing cycle M. The drying cycle D may include drying the dishes using heated air or non-heated air.

First, in the preliminary washing cycle P, water may be supplied to the items to be washed without heating the water in the sump 200. The preliminary washing cycle P may be performed as a first attempt to remove foreign matter attached to the items being washed.

In one embodiment, the upper spray arm 230 and the lower spray arm 220 may be alternately supplied with water to spray the water onto the items being washed. That is, a water spraying action performed in the preliminary washing cycle P may include an upper water spraying action for supplying water through the upper spray arm 230 and a lower water spraying action for supplying water through the lower spray arm 220. The spraying actions may be performed repeatedly. The spraying actions alternate between the upper spray arm 230 and the lower spray arm 220. They may be performed for the same, or different, time intervals. For example, the upper water spraying action and the lower water spraying action may be alternately performed for one minute each.

In one embodiment, during the preliminary washing cycle P, the steam heater 310 and the sump heater 290 may be maintained in an off state. In this case, an inner temperature of the washing compartment 150 into which the wash water is sprayed is substantially the same as the temperature of the water supplied into the sump 200 from the outside.

Also, heated washing water, with or without detergent, or unheated washing water, with or without detergent, may be supplied in the preliminary washing cycle P according to the present invention without departing from the scope of the invention.

After the preliminary washing cycle P is completed, the main washing cycle M may be performed. The main washing cycle M may include a first main washing step M1 for spraying heated wash water onto to items, a second main washing step M2 for alternately spraying steam and wash water onto the items, and a third main washing step M3 for spraying heated wash water to the items.

At the first main washing step Ml, the wash water heated by the sump heater 290 may be supplied to the items being washed after a first set period of time following completion of the preliminary washing cycle P (S20). Specifically, the wash water heated by the sump heater 290 may be pumped to the upper spray arm 230 and the lower spray arm 220 by the pump 210 to alternately and repeatedly spray the items to be washed.

In this case, the steam heater 310 may be maintained in an off state. The first set period of time may be stored in the controller 132 and/or associated memory 134 in advance. In other words, the first set period of time may be preset.

Meanwhile, the sump heater 290 heats the wash water and the heated wash water may be sprayed onto the items to be washed in the washing compartment 150, thereby increasing an atmosphere temperature, that is, a washing temperature of the washing compartment 150.

For example, when an actual temperature of the washing compartment 150 is lower than a predetermined first set temperature T10 of the washing compartment 150, as shown in FIG. 2, the washing temperature of the washing compartment 150 would increase linearly for a first main washing step M1 until it reaches the predetermined first set temperature. In this case, the sump heater 290 may be continuously operated.

However, if the actual temperature of the washing compartment 150 is higher than the first set temperature T10 while the first main washing step M1 is performed, the operation of the sump heater 290 would be stopped. If the temperature of the washing compartment 150 becomes lower than the first set temperature T10 while the operation of the sump heater 290 is stopped, the sump heater 290 may be operated again.

As a result, the sump heater 290 may be powered on and off according to the temperature of the washing compartment 150. In order to prevent the sump heater 290 from being frequently powered on/off, the first set temperature T10 may be expressed as a temperature range. For example, a predetermined first set temperature range may have a range higher or lower by a specified number of degrees than the predetermined first set temperature T10. The predetermined first set temperature T10 or the first set temperature range may be also defined as the temperature of the wash water.

If the first main washing step M1 is completed, the second main washing step M2 may be performed (S30) (FIG. 2). At the second main washing step M2, steam and wash water are alternately supplied for a second set period of time after the first main washing step M1 is completed. In other words, at the second main washing step M2, a steam spraying action for supplying steam to the items to be washed and a water spraying action for supplying wash water to the items to be washed are repeatedly and alternately performed a predetermined number of times.

In this case, the water spraying action functions to remove foreign matter attached to the items. The steam spraying action functions to steep foreign matter in steam such that the attachment between the foreign matter and the item being washed (e.g., rice residue and a dish, respectively) is weakened and the foreign matter attached to the item can be removed more easily than if the foreign matter were not steeped in steam.

Meanwhile, the water spraying action includes a first water spraying action S33 for initiating water spraying on at least one first rack, which may be first exposed to steam, and a second water spraying action S35 for initiating water spraying on at least one second rack among other racks except the first rack.

Particularly, after the steam spraying action S31 is performed, the first water spraying action S33 begins prior to the second water spraying action S35. The foreign matter attached to the items to be washed, which are first exposed to steam through the steam spraying action S31, may be relatively largely steeped in steam. Accordingly, the items to be washed can be efficiently washed by removing the steeped foreign matter first.

The first rack which may be the first one exposed to steam may be installed at the closest position to a steam nozzle that discharges steam. Although the first rack may not be installed at the closest position to the steam nozzle, the first rack may be one that may be first exposed to steam due to directionality of a discharge port of the steam nozzle.

Further, a first water spray time $t_1$ spent during the first water spraying action and a second water spray time $t_2$ spent during the second water spraying action may be set differently from each other. In one embodiment, the first water spray time $t_1$ may be set to be longer than the second water spray time $t_2$.

In this case, if the first water spray time $t_1$ during which water is sprayed to the rack first exposed to steam is set to be longer than the second water spray time $t_2$, the items to be washed can be efficiently washed by washing the items to be washed having a relatively larger amount of foreign matter for a longer period of time.

Meanwhile, as shown in FIGS. 2 and 3, at the second main washing step M2, the steam spraying action S31, the first water spraying action S33 and the second water spraying action S35 may be sequentially, alternately and repeatedly performed. Further, the second main washing step M2 may be performed for a predetermined set period of time (S37) (FIG. 2). If the set period of time has passed, a third main washing step M3 is performed (S40) (FIG. 2).

Further, in the steam spraying action, the steam heater 310 for generating steam may be maintained in an on state. In the water spraying action, the steam heater 310 may be in an off state. At the second main washing step M2, the sump heater 290 may be turned off, and the steam heater 310 for generating steam may be periodically powered on and off to alternately supply the wash water and steam to the items to be washed for the second set period of time.

In this case, since the sump heater 290 may be maintained in an off state, unheated wash water may be supplied to the items to be washed through the upper spray arm 230 and the lower spray arm 220 during the water spraying action. In this case, since the supplied water may be used without being additionally heated at the second main washing step M2, there is an advantage of reducing power consumption.

Meanwhile, the atmosphere temperature of the washing compartment 150 gradually increases due to the supply of steam. For example, the washing temperature of the washing compartment 150 during the steam spraying action may increase instantaneously in a stepped shape compared to the temperature of the water spraying action.

Referring to FIG. 2, temperature increase amounts F1, F2, and F3 may be gradually decreasing during successive steam spraying actions for the following reason: since the washing temperature of the washing compartment 150 has increased already by a specified temperature while the steam spraying action is performed, the influence of the steam spraying action performed later becomes weak. That is, since a temperature difference between the steam and the inside of the washing compartment 150 gradually decreases when the steam spraying action is repeatedly performed, a heat transfer amount from the steam to the inside of the washing compartment 150 would gradually decrease.

When the second main washing step M2 is completed, the third main washing step M3 may be performed (S40) (FIG. 2). At the third main washing step M3, the wash water heated by the sump heater 290 may be supplied to the items to be washed for a third set period of time.

Specifically, the third main washing step M3 includes a first water spraying action for initiating water spraying on a predetermined steam zone SP1 (FIG. 5) of an inner space of the washing compartment 150 and a second water spraying action for initiating water spraying on the other zone except the steam zone SP1 of the inner space of the washing compartment 150.

Particularly, after the second main washing step M2, the first water spraying action begins prior to the second water spraying action. Accordingly, it is possible to increase washability by first washing the items to be washed disposed in a zone under the largest influence of steam.

Figure 5:
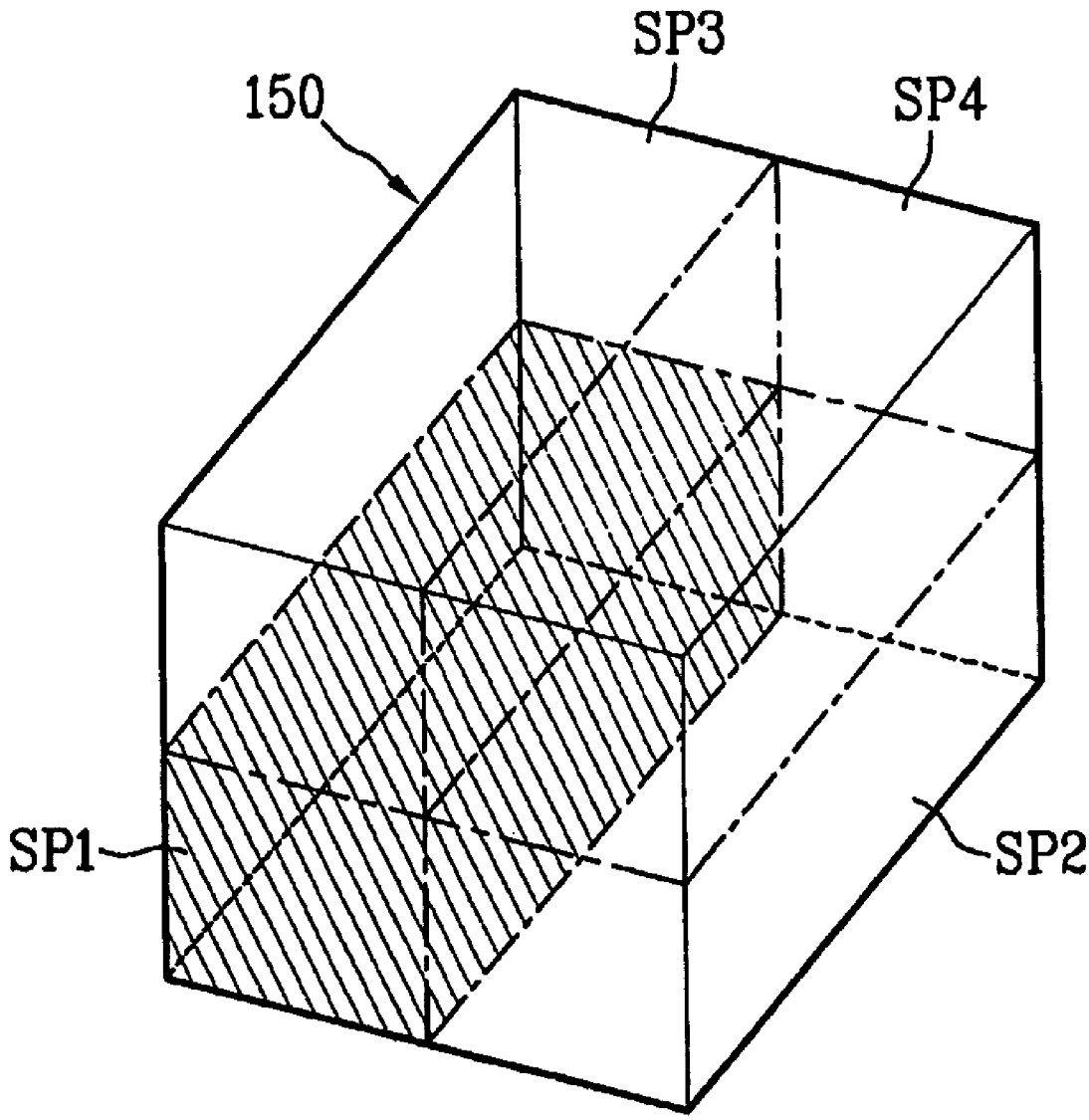
FIG. 5 illustrates steam zones of a washing compartment disposed in a dish washing machine according to an embodiment of the invention.

In this case, as shown in FIG. 5, the steam zone SP1 may be a zone set by the user in advance, which may be defined as a zone with dense steam. For example, the space of the washing compartment 150 may be divided into four spaces SP1, SP2, SP3, and SP4. Then, any one space of the four spaces, that is, the steam zone SP1 may be defined as a zone having the highest steam density.

The steam zone SP1 may be a zone that is exposed to the steam for the longest period of time. The zone that is exposed to the steam for the longest period of time would be a zone that is first exposed to the steam. Further, a space defined as the steam zone may be stored in the controller 132 and/or associated memory 134 in advance based on experimental data.

Furthermore, the steam zone may be defined as a zone in which the first rack first exposed to the steam is installed.

In this embodiment, the steam zone may be the lower rack 170 on which water is sprayed through the lower spray arm 220, and the other zone except the steam zone may be the upper rack 160 on which water is sprayed through the upper spray arm 230.

At the third main washing step M3, the first water spraying action for spraying water on the lower rack 170 and the second water spraying action for spraying water on the upper rack 160 are repeatedly performed. In this case, the first water spray time $t_3$ (FIG. 2) spent during the first water spraying action and the second water spray time $t_4$ (FIG. 2) spent during the second water spraying action may be irregular. That is, they are not necessarily equal.

For example, as illustrate in FIG. 2, times $t_3$ and $t_5$ spent during the first water spraying action and times $t_4$ and $t_6$ spent during the second water spraying action have different time intervals. Particularly, in the first water spraying action, the water spray time $t_3$ spent during an initial first water spraying action performed right after the second main washing step M2 has the longest time.

If the water spray time $t_3$ spent during the initial first water spraying action is set to be the longest, the items to be washed can be efficiently washed by washing the items to be washed having a relatively larger amount of foreign matter for a longer period of time.

Furthermore, since a relatively larger amount of foreign matter may be attached to the lower rack 170 through the second main washing step M2, if the water spray time $t_3$ spent during the initial first water spraying action is set to be the longest, the items to be washed can be cleanly and quickly washed.

Furthermore, the third main washing step M3 may be completed with the second water spraying action. Since it may be completed with the second water spraying action, there may be an effect of entirely washing foreign matter at a final step of the main washing cycle M.

Meanwhile, the washing temperature of the washing compartment 150 increases by supplying the wash water heated by the sump heater 290 to the washing compartment 150. In the same way, the sump heater 290 may be powered on and off according to the temperature of the washing compartment 150 or the temperature of the wash water.

Only heated wash water is supplied at the third main washing step M3 in the same way as at the first main washing step M1. However, the washing temperature of the washing compartment 150 at the third main washing step M3 may be higher than the washing temperature of the washing compartment 150 at the first main washing step M1. That is because the temperature of the items to be washed or the inner temperature of the washing compartment 150 has already increased by a specified temperature at the second main washing step M2.

Furthermore, a first gradient al, which indicates a temperature variation of the washing compartment 150 at the first main washing step M1, is larger than a second gradient $a_2$, which indicates a temperature variation of the washing compartment 150 at the third main washing step M3.

That is, on the assumption that an operation time of the first main washing step M1 is equal to an operation time of the third main washing step M3, a temperature variation (T10-T00) at the first main washing step M1 is larger than a temperature variation (T30-T20) at the third main washing step M3.

Similarly, that is because the wash water heated by the sump heater 290 has relatively less influence on the temperature variation of the washing compartment 150 at the third main washing step M3 compared to the first main washing step M1 since the temperature of the washing compartment 150 has already increased by a specified temperature at the third main washing step M3.

When the main washing cycle M is completed, the circulated wash water may be discharged to the outside through the water drain tube 270 (FIG. 1), and the rinsing cycle R for supplying fresh water to the items to be washed begins. In the rinsing cycle R, wash water may be supplied to the items to be washed. Generally, the wash water may be supplied in an unheated state. In this case, although unheated wash water may be supplied to the items to be washed, the washing temperature of the washing compartment 150 may be maintained to be higher than the temperature of the preliminary washing cycle P. That is because the temperature of the items to be washed or the inner temperature of the washing compartment 150 has already increased by a specified temperature through the main washing cycle M.

In the rinsing cycle R, heated wash water may be supplied, and the wash water and steam may be sprayed at the same time or alternately. Further, when the rinsing cycle R is completed, a drying cycle for drying the items to be washed by supplying cold air or hot air to the items to be washed may be performed.

Figure 4:
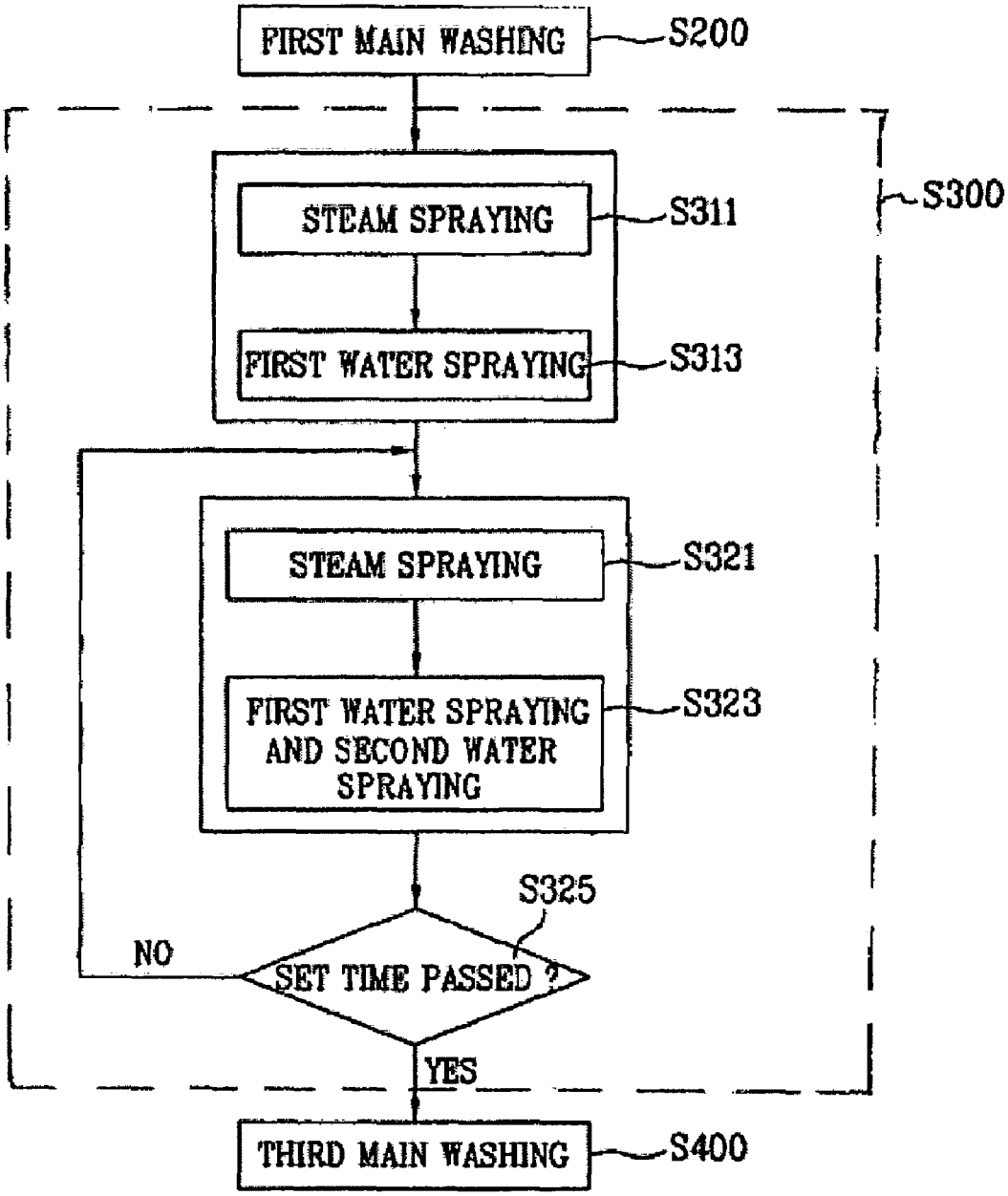
FIG. 4 is a flow chart showing a main washing cycle according to another embodiment of the invention.

Referring to FIG. 4, a method of controlling a dish washing machine according to another embodiment of the present invention is explained.

In the same way as in the above-described embodiment, a main washing cycle includes a first main washing step (S200), a second main washing step (S300) and a third main washing step (S400). Furthermore, the second main washing step (S300) includes a steam spraying action and a water spraying action.

However, the second main washing step (S300) according to this embodiment includes a first water spraying action for initiating water spraying on at least one first rack which may be first exposed to steam, and a second water spraying action for initiating water spraying on at least one second rack among other racks except the first rack, which are performed at the same time at least one time.

Specifically, after the first main washing step S200 is completed, the steam spraying action may be performed first (S311). Then, the first water spraying action for spraying water on the first rack in the first place may be performed (S313).

Then, the steam spraying action for spraying steam may be performed again (S321). After the steam spraying action is completed, the first water spraying action and the second water spraying action are performed at the same time (S323). While those actions are performed, if a predetermined set period of time for performing the second main washing step M2 has passed, the third main washing step may be performed (S400).

It will be apparent to those skilled in the art that various modifications and variations can be made from the embodiments described herein without departing from the spirit or scope of the invention. Thus, it is intended that the claims appended hereto cover the modifications and variations.

What is claimed is:

1. A method of controlling a dish washing machine comprising:

performing a steam spraying action into a tub;

initiating a first water spraying action on a predefined steam zone; and initiating a second water spraying action on the predefined steam zone and on a zone outside the predefined steam zone, wherein the first water spraying action begins prior to the second water spraying action, and the predefined steam zone is exposed to steam for a greater time duration than the steam zone located outside the predefined steam zone.

2. The method of claim 1, wherein the predefined steam zone holds a greater density of steam than the zone outside the predefined steam zone.

3. The method of claim 1, wherein the tub has a plurality of racks, and at least one of a first rack of the plurality of racks is provided in the predetermined steam zone and at least one of a second rack of the plurality of racks is provided in the zone outside the predetermined steam zone.

4. The method of claim 1, wherein a first duration time spent during the first water spraying action is different from a second duration time spent during the second water spraying action.

5. The method of claim 1, wherein the first water spraying action and the second water spraying action are selectively operated.

6. The method of claim 1, wherein the steam spraying action, the first water spraying action, and the second water spraying action operate successively and repeatedly.

7. The method of claim 3, wherein the first rack is located closer to a steam nozzle, that emits steam, than any one of the other racks in the plurality of racks.

8. A method of controlling a dish washing machine comprising:

performing a second main washing step using steam and water; and performing a third main washing step including a first water spraying action on a predefined steam zone, and a second water spraying action on the predefined steam zone and on a zone outside the predefined steam zone, wherein the first water spraying action begins prior to the second water spraying action, after the second main washing step has completed.

9. The method of claim 8, further comprising:

performing a first main washing step before the second main washing step, wherein the first main washing step is performed with the water having a second temperature greater than a first temperature and before the second main washing step.

10. The method of claim 8, wherein the first water spraying action and the second water spraying action are repeated for a predetermined duration.

11. The method of claim 10, wherein the first water spraying action and the second water spraying action are concurrently operated.

12. The method of claim 10, wherein the third main washing step is completed before beginning the second water spraying action.

13. The method of claim 10, wherein a first duration time spent during the first water spraying action and a second duration time spent during the second water spraying action are not equal in duration.

14. The method of claim 10, wherein an initial first spraying water action begins after the second main washing step is finished, the initial first spraying water action having a time duration greater than any one of a water spraying action within the first water spraying action.

15. The method of claim 9, wherein the first main washing step includes a first main water spraying action on a predetermined steam zone, and a second main water spraying action on a space outside the predetermined steam zone.

16. The method of claim 15, wherein the water sprayed during the first main washing step is heated by a sump heater.

17. The method of claim 16, wherein the sump heater is controlled based on a temperature of the water and a tub.

18. The method of claim 8, wherein the second main washing step includes a steam spraying action in conjunction with operating a steam heater, and a water spraying action after the operation of the steam heater.

19. The method of claim 18, wherein a sump heater configured to heat the water in a sump is operated before the start of the second main washing step and after the end of the second main washing step.

20. A method of controlling a dish washing machine comprising:

performing a steam spraying action into a tub;

initiating a first water spraying action on a predefined steam zone; and initiating a second water spraying action on a zone outside the predefined steam zone, wherein the first water spraying action begins prior to the second water spraying action, and the predefined steam zone is exposed to steam for a greater time duration than a steam zone located outside the predefined steam zone.

21. A method of controlling a dish washing machine comprising:

performing a second main washing step using steam and water; and performing a third main washing step including a first water spraying action on a predefined steam zone, and a second water spraying action on a zone outside the predefined steam zone, wherein the first water spraying action begins prior to the second water spraying action, after the second main washing step has completed.

22. The method of claim 21, further comprising:

performing a first main washing step before the second main washing step, wherein the first main washing step is performed with hot water.

* * * * *